United States Patent [19]

Mauro, Jr. et al.

[11] 4,101,041

[45] Jul. 18, 1978

[54] PREFILLABLE, HERMETICALLY SEALED CONTAINER ADAPTED FOR USE WITH A HUMIDIFIER OR NEBULIZER HEAD

[75] Inventors: Charles L. Mauro, Jr., New York, N.Y.; Theodore L. Siuta, Elizabeth, N.J.; Gordon Sylvester, Jamaica, N.Y.

[73] Assignee: Becton, Dickinson and Company, Rutherford, N.J.

[21] Appl. No.: 820,641

[22] Filed: Aug. 1, 1977

[51] Int. Cl.[2] ..... B65D 1/02

[52] U.S. Cl. ..... 215/6; 215/1 C; 215/32

[58] Field of Search ..... 215/1 C, 6; 239/338; 220/20

[56] References Cited

U.S. PATENT DOCUMENTS

| | | | |
|---|---|---|---|
| 781,053 | 1/1905 | DeVore | 215/6 |
| 3,923,178 | 12/1975 | Welker | 215/1 C |

FOREIGN PATENT DOCUMENTS

| | | | |
|---|---|---|---|
| 1,063,387 | 12/1953 | France | 215/6 |

*Primary Examiner*—Donald F. Norton
*Attorney, Agent, or Firm*—Kane, Dalsimer, Kane, Sullivan and Kurucz

[57] ABSTRACT

A novel, prefillable, hermetically sealed container adapted for use with a humidifier or nebulizer head. The container includes a gas conduit for directing a gas flow to the bottom of the container and means for establishing connection between the gas conduit and the humidifier or nebulizer head.

6 Claims, 10 Drawing Figures

PREFILLABLE, HERMETICALLY SEALED CONTAINER ADAPTED FOR USE WITH A HUMIDIFIER OR NEBULIZER HEAD

BACKGROUND OF THE INVENTION

1. Field of the Invention

The invention concerns prefillable, hermetically sealed containers and more particularly concerns fluid containers useful in association with humidifiers and nebulizers.

2. Brief Description of the Prior Art

The prior art is replete with descriptions of containers, humidifiers and nebulizers. Representative of the prior art are the disclosures of U.S. Pat. Nos. 365,265; 2,819,716; 3,652,015; 3,744,722; 3,793,810; 3,826,255; 3,836,079; and 3,864,326.

SUMMARY OF THE INVENTION

The invention comprises a unitary, prefillable, hermetically sealed, thermoplastic container adapted for use with a humidifier or a nebulizer head, which comprises; a thermoplastic body having a closed first end and a closed removable second end, said body defining an interior chamber for holding a fluid, means for removing said second end attached to said body; a conduit providing communication between a point within said chamber adjacent said closed first end and a point within said chamber adjacent said closed second end, said conduit having frusto-conical shaped sidewalls at the point adjacent said second end; support means for said conduit, connected to said body; and means for attaching a humidifier or nebulizer head to said body upon removal of said closed, second end.

The containers of the invention may be prefilled with distilled water, medications and the like and hermetically sealed. For use, the removable closed end may be quickly removed and replaced with a conventional humidifier or nebulizer head. The container provides for rapid and efficient set-up of a humidifier or nebulizer.

DETAILED DESCRIPTION OF THE PREFERRED EMBODIMENTS OF THE INVENTION

A complete appreciation of the invention may be obtained by referring to the embodiments shown in the accompanying drawings of FIGS. 1–10, inclusive.

Figure 1:
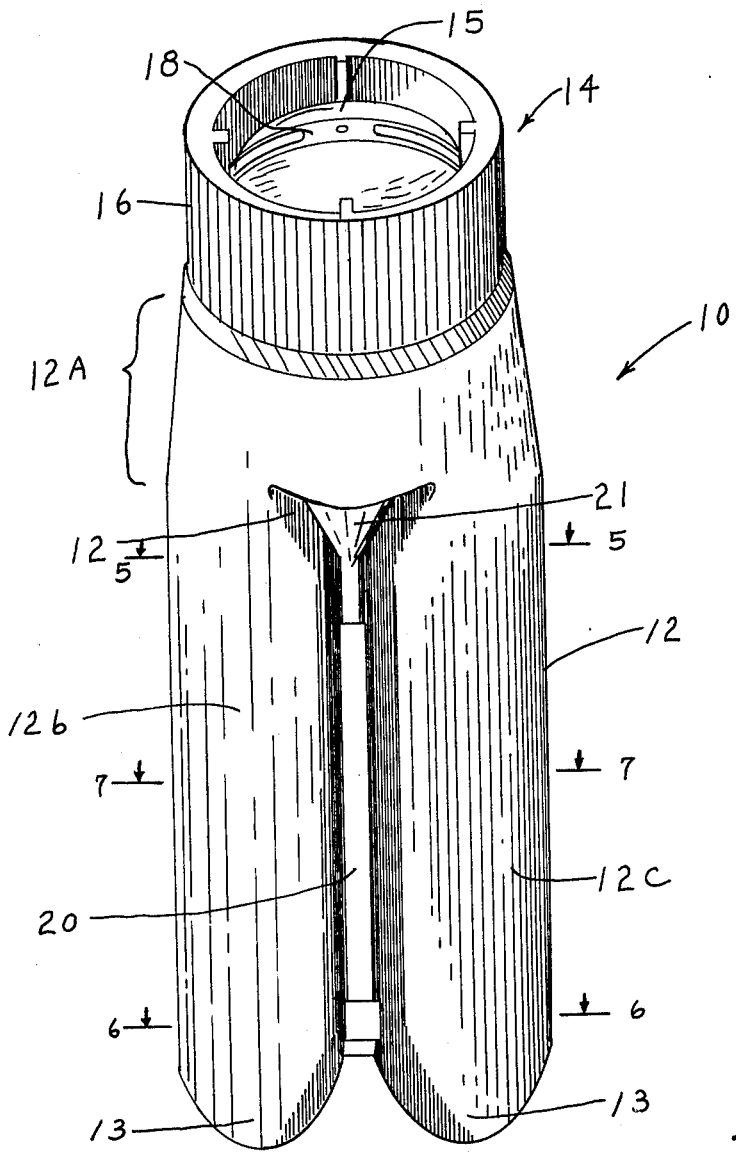
FIG. 1 is an isometric view of an embodiment container of the invention.

FIG. 1, an isometric view of an embodiment container 10 of the invention shows body walls 12 and a removable end 14. End 14 includes a cap 15, a finger engaging hub 16 and a retainer strap 18 over cap 15. Body 12 may be fabricated from any convenient material conventionally employed to fabricate thermoplastic containers. Preferably, body 12 is fabricated from a synthetic polymeric resin such as polyethylene, polypropylene, polybutylene and like resins. The body 12 is advantageously blow-molded to provide a unitary, generally cylindrical upper portion 12A and a bifurcated lower portion comprising stems 12B and 12C. The two stems 12B and 12C are joined together by a common wall 20 and terminate at closed end 13. The upper end of wall 20 terminates in an integrally molded section having the configuration of one-half of a funnel. This section 21 together with its other half on the reverse side forms a funnel 28 (not seen in FIG. 1) on the interior wall of the container 10. The purpose of this funnel 28 configuration will be discussed in greater detail hereinafter.

Figure 2:
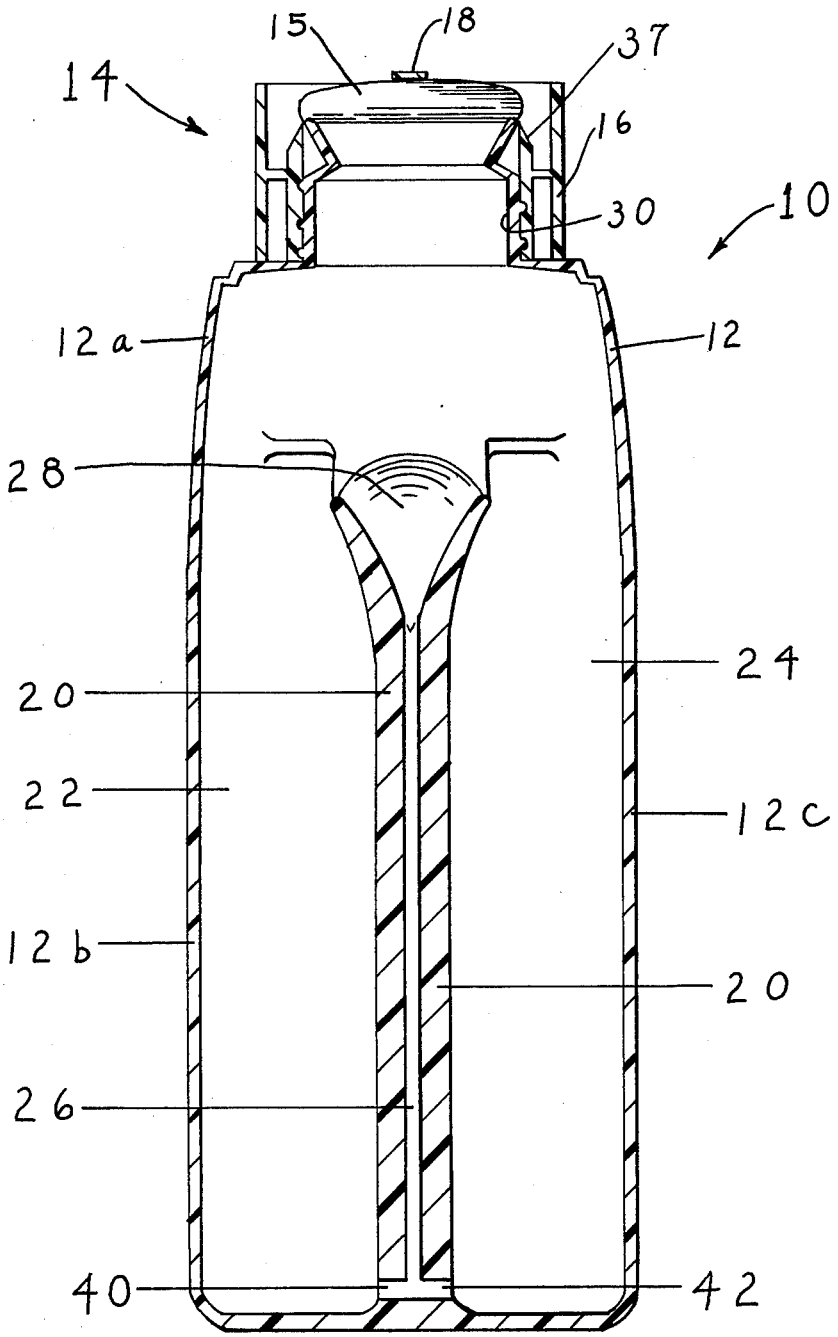
FIG. 2 is a cross-sectional side elevation of the embodiment seen in FIG. 1.

Referring now to FIG. 2, a cross-sectional side elevation of the container 12 as viewed in FIG. 1, it is seen that the common wall 20 separates the two stems 12B and 12C of the lower portion of container 10 to define separate wells 22 and 24 inside the container 12. A bore 26 traverses the length of wall 20 and provides open communication between the bottom of each wall 22 and 24 through the respective apertures 40 and 42. In addition, the bore 26 communicates at its upper end with the cavity defined by the walls of the upper portion 12A of container 12. The wells 22 and 24 also communicate openly with the cavity defined by walls 12 of the upper portion 12A of container 10. The upper portion 28 of wall 20 angles away from the centerline of the container 10 so that bore 26 takes on a frusto-conical shape forming an integral funnel 28 at the upper end of wall 20. The purpose of funnel 28 is to receive a dip tube component of a nebulizer or humidifier head and direct it into sealing engagement with the bore 26 as will be described hereinafter in greater detail.

Figure 3:
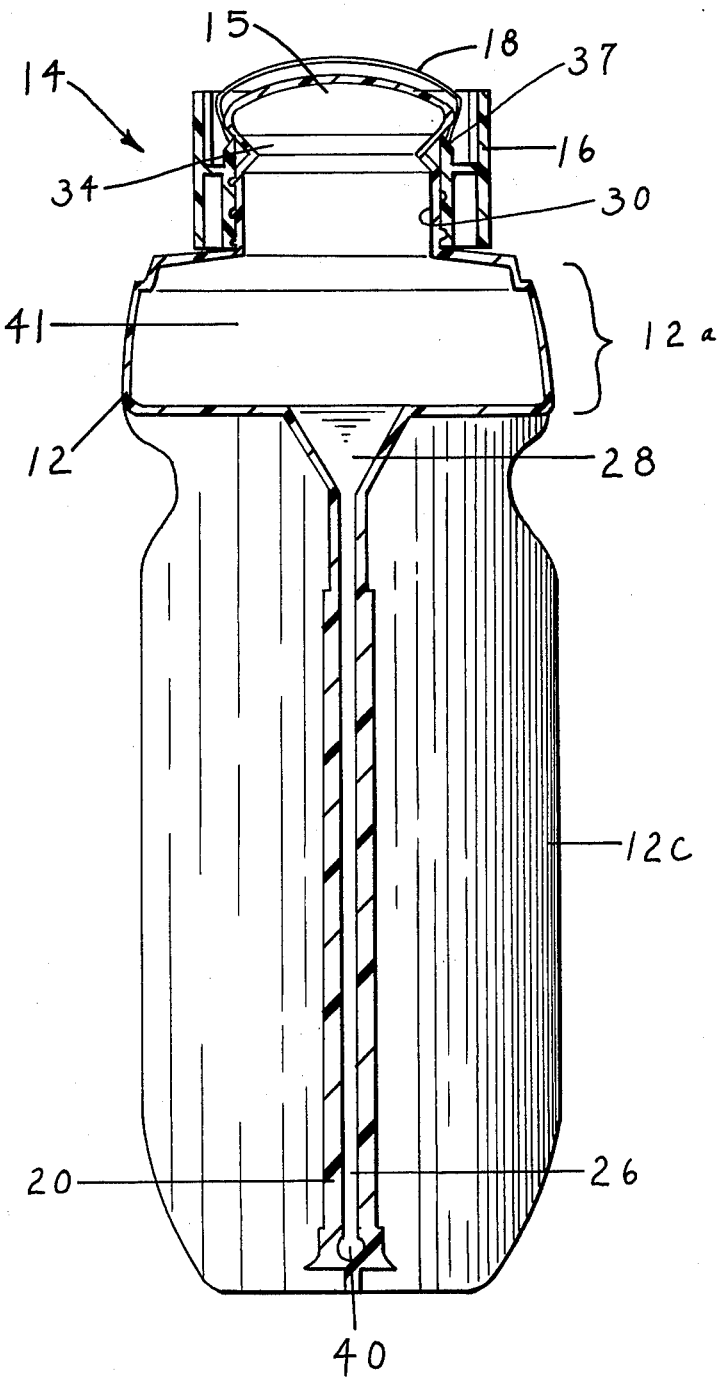
FIG. 3 is a cross-sectional front elevation of the embodiment seen in FIG. 1.

FIG. 3 is a cross-sectional front elevation of the container 10 shown in FIG. 1 and shows the stem 12C of the container 10. FIG. 3 shows particularly that the wall 20, including funnel 28 and its upper end is an integral and continuous part of body 12. In fact, with the exception of finger engaging hub 16 and retainer strap 18, the rest of the container 10 structure is an integral, one piece, blow-molded unit. In FIG. 3, the symbol 41 shows the interior cavity of container 12 above well 24. In FIG. 3, the removable closed end 14 can also be seen to consist of cap 15 integrally molded and connected to walls 12 by neck 30. Neck 30 has a weak, ready fracturable zone 34 just below cap 15.

Figure 5:
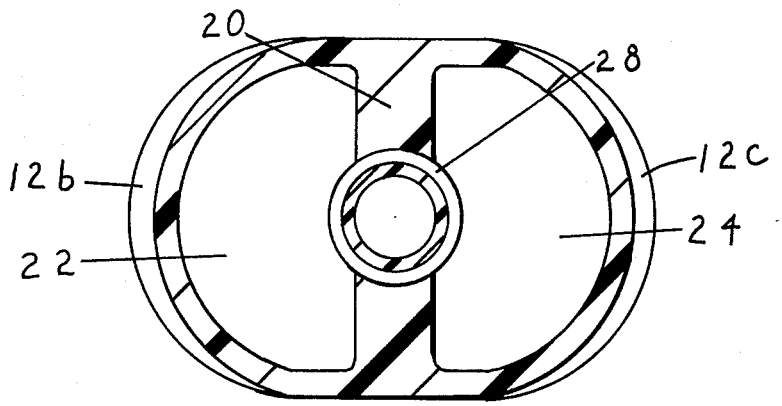
FIG. 5 is a cross-sectional view along line 5—5 of FIG. 1.

Referring next to FIG. 5, a cross-sectional view along line 5—5 of FIG. 1, the spacial relationship of the wall 20, wells 22 and 24 and funnel 28 are more clearly observed.

Figure 6:
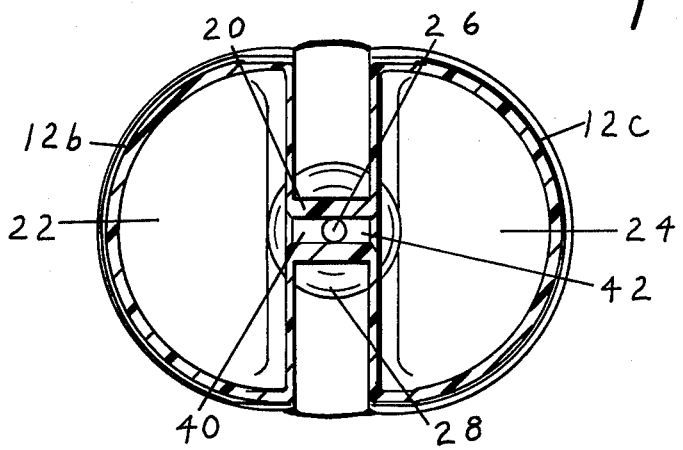
FIG. 6 is a cross-sectional view along line 6—6 of FIG. 1.

Referring now to FIG. 6, a cross-sectional view along line 6—6 of FIG. 1, the base portion of the container 10 is clearly seen and shows again the relationship of the stems 12C and 12B to wall 20 and the bore 26 within wall 20. At the base of wells 22 and 24, the apertures 40 and 42, respectively, provide communication between the wells 22, 24.

Figure 7:
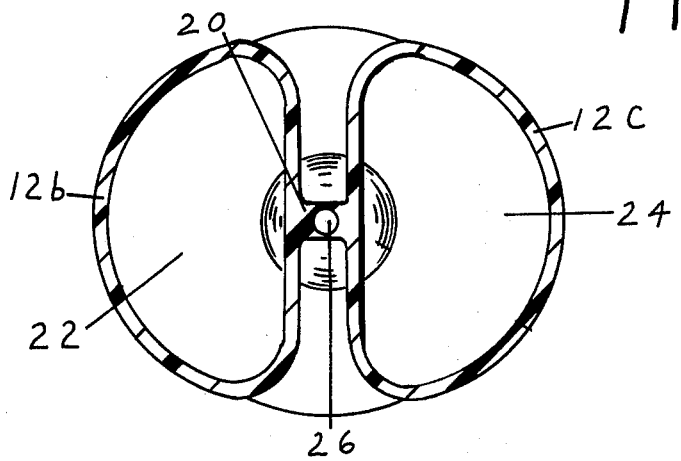
FIG. 7 is a cross-sectional view along line 7—7 of FIG. 1.

Referring now to FIG. 7, a cross-sectional view along line 7—7 of FIG. 1, the relationship of the stems 12C and 12B to each other wherein they are commonly joined by wall 20 is clearly shown.

Figure 4:
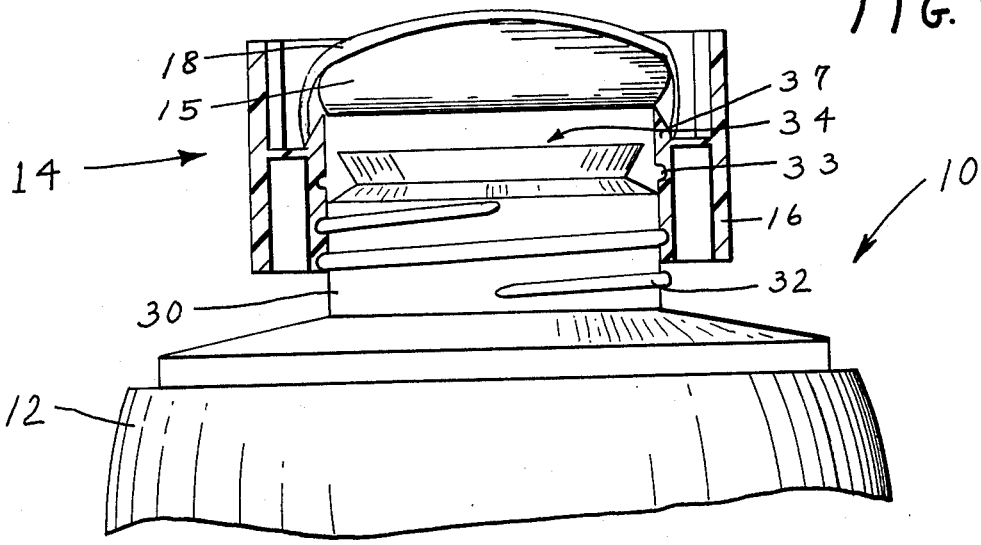
FIG. 4 is an enlarged cross-sectional in part side elevation of the removable end of the embodiment container of FIG. 1.

It is important that the fluid contents of the prefilled container 10 be protected from contamination prior to use. To assist in such protection, the container 10 includes a hermetically sealed but removable end 14. Referring now to FIG. 4, an enlarged view of the upper end of container 10, the removable end 14 may be seen in greater detail. Removable end 14 includes a cap 15 which is an integrally molded part of wall 12, joined thereto by neck 30. Neck 30 has helical threads 32 which are integrally molded on neck 30 of container body 12. To facilitate fracturing and removal of cap 15, a finger grasping or grasp facilitating hub 16 is screw mounted on neck 30 by threads 32 engaging helical grooves 33. As shown in FIG. 4, the hub 16 has been partially removed by unscrewing. As it lifts off from neck 30, integral wedges 37 are pressed against the fracturable zone 34. Rotation of hub 16 carries the wedges 37 through zone 34 and fracture cap 16. Continued unscrewing of hub 16 carries cap 16 off as shown in FIG. 4, retaining the cap 15 in hub 16 with strap 18. Strap 18 holds cap 15 down against wedges 37 during lift off. If desired, the removed hub 16 with captured cap 15 may be replaced on neck 30 to protect the open end from contaminants prior to use.

Figure 8:
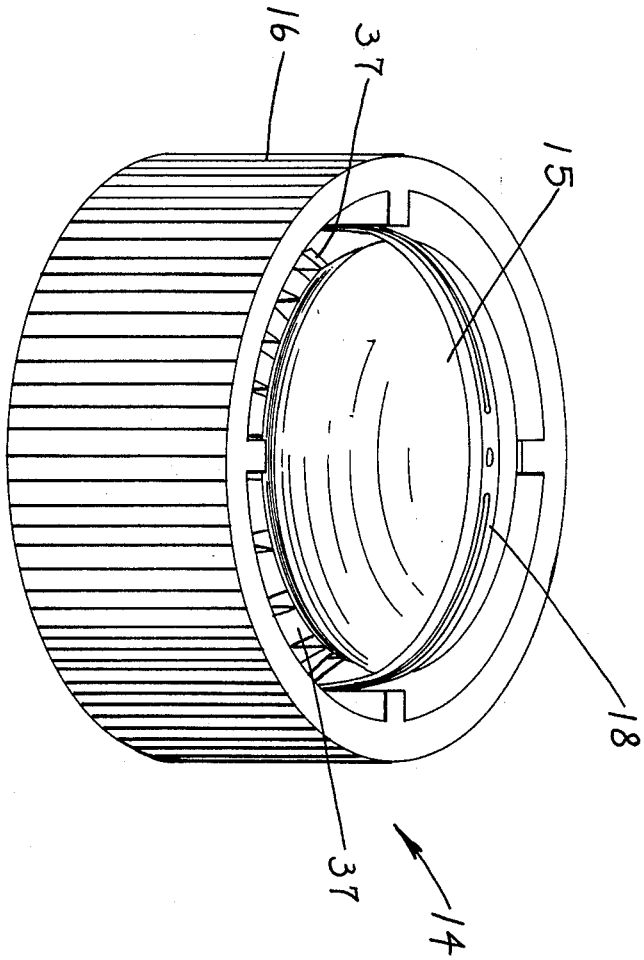
FIG. 8 is an enlarged view of the removable portion of the container seen in FIG. 1, with a means for removing.

FIG. 8 is an enlarged view of the removable portion of the container 10 after fracture and removal of hub 16 with cap 15 held against wedges 37 by retainer strap 18.

The unique construction of the container 10 permits its efficient use in association with a nebulizer or humidifier head. Conventional humidifier heads have a dip tube component designed to be placed in a column of water for moisturization i.e.; increasing the water vapor content of the gas prior to its administration to a mammal. Nebulizer heads for vaporizing a liquid are similarly constructed, with a dip tube placed in the liquid. The integrally molded "dip tube" and the guide means (funnel 28) associated with the container 10 of the invention is ideally suited for rapid and efficient connection with the dip tube member of the conventional nebulizer or humidifier head.

Figure 9:
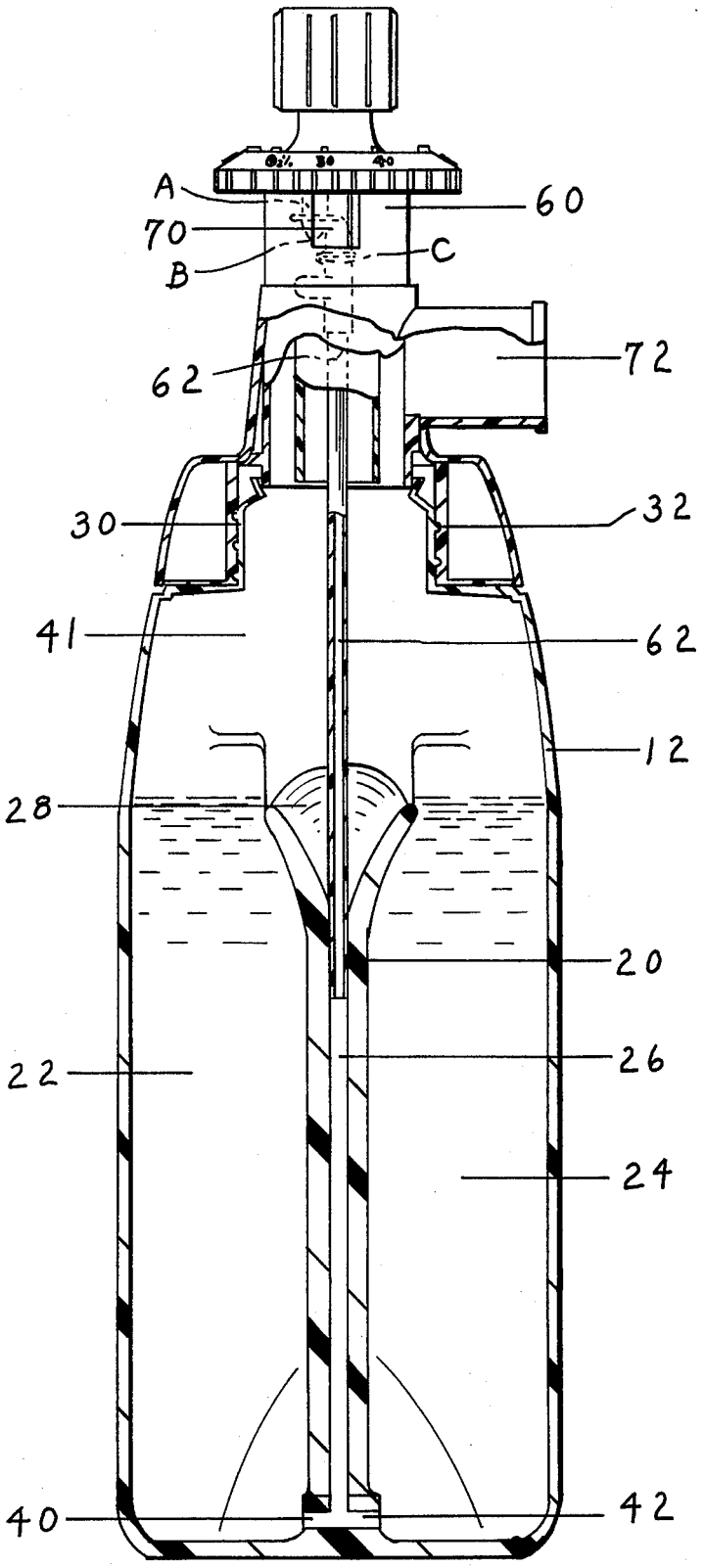
FIG. 9 is a cross-sectional side elevation of the embodiment of FIG. 1 but after replacement of the removable end with a nebulizer head.

The container embodiment 10 is employed by prefilling and hermetically sealing a liquid such as distilled water, a decongestant or like fluid medications in the wells 22 and 24 at the time the container is blow-molded. The technique is well known; see for example U.S. Pat. Nos. 3,597,793 and 3,919,374. The prefilled container 10 may be stored safely until its use is desired. At the time when the container 10 and its contents is to be employed, removable end 14 is removed and replaced with a conventional humidifier or nebulizer head as desired. The humidifier or nebulizer head may be screwed on to the threads 32 of neck 30 of the container 10 and employed in a conventional manner well known to those skilled in the art. The container may also be filled after blow-molding if so desired. Referring to FIG. 9, there is seen a cross-sectional side elevation of the embodiment shown in FIG. 1 but after replacing severable end 14 with a conventional nebulizer head. The head 60 has been mounted on neck 30 by taking advantage of the threads 32 and screwing head 60 thereon. Dip tube 62 is a component part of the nebulizer 60. As the head 60 is mounted on neck 30, the dip tube 62 is inserted into funnel 28. As the head 60 is screwed on, dip tube 62 is pressed downward and guided by funnel 28 into hermetic sealing engagement with the bore 26 as shown in the FIG. 9. With the mating of tube 62 and bore 26, a continuous, uninterrupted, connection is established between the air, oxygen or other medical gas which will be introduced into head 60. In operation, a medical gas is conventionally directed through nebulizer head 60 (ultimately through orifice "B" of nozzle "A" which is connected to dip tube 62). The vacuum produced draws liquid from wells 22 and 24 through respective apertures 40 and 42 through bore 26 and out orifice "C." Due to the symmetry of bore 26 and the discharge apertures 40, 42 substantially equal volumes of liquid are drawn from each of the wells 22 and 24. On leaving orifice "C" of nozzle "A," the liquid, for example water, is nebulized. The aerosol, after entering chamber 41 is usually mixed with a preparation of air as shown entering the nebulizer head through portal 70. After mixture with air, the aerosol found in chamber 41 is administered to a patient by exhaustion through portal 72.

Figure 10:
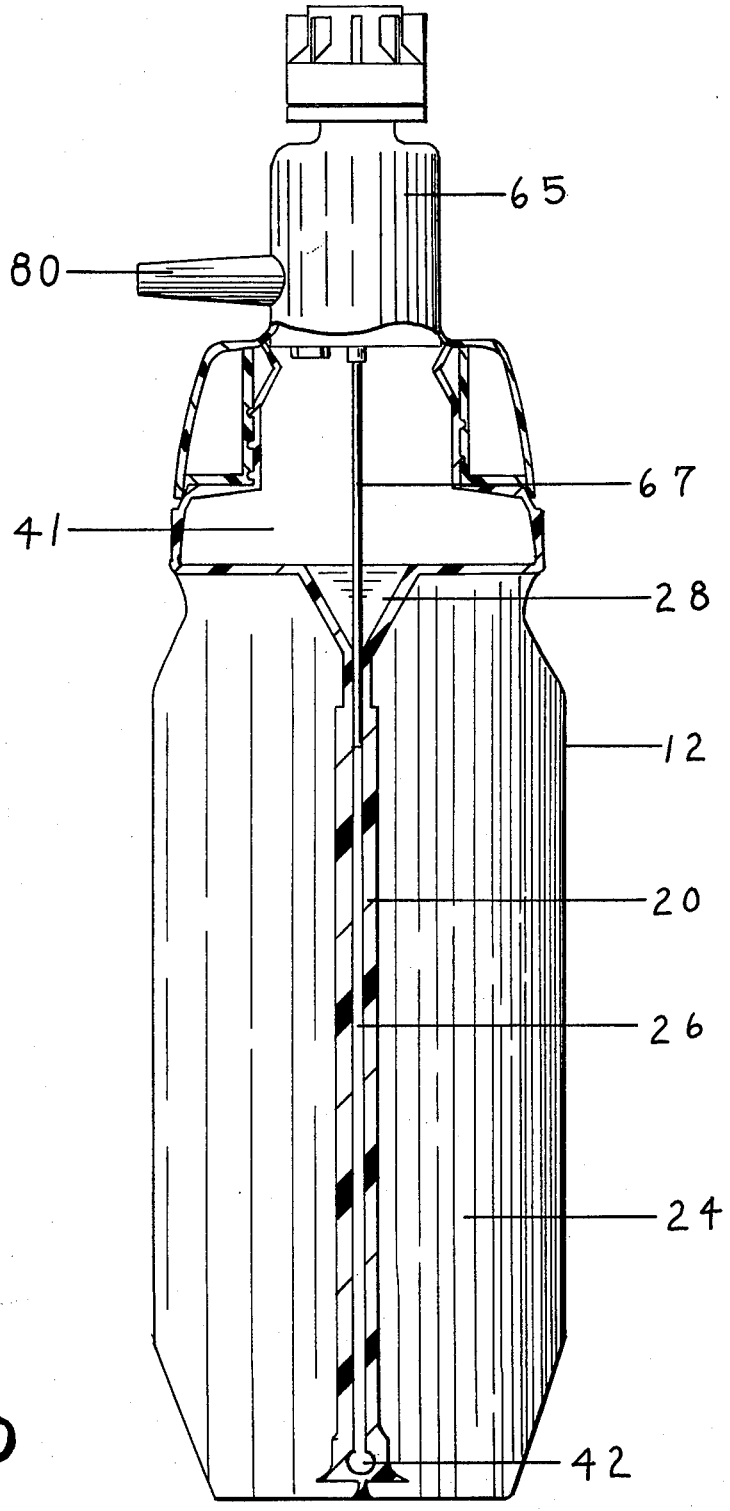
FIG. 10 is a cross-sectional front elevation of the embodiment of FIG. 1 but after replacing the removable end with a humidifier head.

Referring now to FIG. 10, there is seen a cross-sectional front elevation of the embodiment container 10 shown in FIG. 1 but after replacing the severable end 14 with a humidifier head 65. The humidifier head 65 is mounted in the same manner described above for nebulizer head 60. Thus, as shown in FIG. 10, the dip tube 67 component of humidifier head 65 mates by virtue of its guidance through funnel 28 with bore 26. Medical gases such as oxygen directed into head 65 are ultimately conveyed by dip tube 67 into the bore 26. The gases are carried by bore 26 into the wells 22 and 24 holding water (well 22 not shown in FIG. 10). The gas ultimately reaches chamber 41 after increasing its water vapor content by rising naturally through liquid filled wells 22 and 24, and is discharged through conduit 80 for administration to a mammal.

From the above description, it will be appreciated by those skilled in the art that the prefillable, hermetically sealed container of applicant's invention is advantageously employed in association with a conventional humidifier or nebulizer head. The integrally molded, "dip tube" within the body of the container of applicant's invention enables one to form a continuous path between the gas to be vaporized or moisturized and the bottom of a column of moisturant. The integrally molded "dip tube" of the container of the invention enables one to rapidly mount the nebulizer or humidifier head with a minimum of exposure of the contained fluids to contamination by the atmosphere. Those skilled in the art will also appreciate that many variations to the embodiment container 10 as hereinbefore described may be effected without departing from the spirit and the scope of the invention. For example, the hub 16 may be snap-fitted to neck 30 instead of being screw mounted. Further, although the container 10 has been described as having a bifurcated body for forming two chambers for containing liquids, a single chamber container may be provided and the conduit 26 attached to a sidewall thereof. In addition, the conduit 26 may also be bifurcated so that one branch reaches the point adjacent the closed end of the chamber by a different course or route than the other branch. Further, a diffuser may be attached to the end of the conduit 26.

The container 10 with its bifurcated body is particularly advantageous for use with humidifiers or nebulizers wherein one wishes to heat the contents of the container 10. The bifurcation provides a greater container surface area for the container 10, to which a heating means such as an electric heating mantle may be applied.

What is claimed:

1. A unitary, prefillable, hermetically sealed, container adapted for use with a humidifier or nebulizer head, which comprises;

a thermoplastic body having a closed first end and a closed removable second end, said body defining an interior chamber for holding a fluid;

a conduit communicating between a point within said chamber adjacent said closed first end and a point within said chamber adjacent said closed second end, said conduit having a guide means for receiving a tube at the point adjacent said second end;

support means for said conduit connected to said body; and means for attaching a humidifier or nebulizer head to said body upon removal of said closed, removable second end.

2. The container of claim 1 wherein said body has a generally cylindrical upper portion and a bifurcated lower portion, the stems of said bifurcate lower portion defining separate wells within said body, said wells being in open communication with each other and with the cavity defined by the upper portion of said body.

3. A container according to claim 1 wherein said support means is the walls for said body.

4. A container according to claim 1 wherein a liquid is disposed therein.

5. A container according to claim 1 wherein said means for attaching a humidifier or nebulizer are screw threads integrally molded on said thermoplastic body.

6. A container according to claim 1 wherein said guide means comprises frusto-conical shaped sidewalls of said conduit.

* * * * *